United States Patent [19]

Platt

[11] Patent Number: 4,561,278

[45] Date of Patent: Dec. 31, 1985

[54] COILING MACHINE

[75] Inventor: Stephen A. Platt, Grand Haven, Mich.

[73] Assignee: S. A. Platt, Inc., Grand Haven, Mich.

[21] Appl. No.: 652,509

[22] Filed: Sep. 20, 1984

[51] Int. Cl.[4] ..... B21F 3/02; B21F 3/04

[52] U.S. Cl. ..... 72/142; 72/145; 242/7.01

[58] Field of Search ..... 72/142, 143, 145, 138; 242/7.01, 7.06, 7.07, 54 R

[56] References Cited

U.S. PATENT DOCUMENTS

| | | | |
|---|---|---|---|
| 2,227,602 | 1/1941 | Platt | 72/145 |
| 2,388,401 | 11/1945 | Freundlich | 72/142 |
| 2,909,209 | 10/1959 | Ciccone et al. | 72/145 |
| 3,082,810 | 3/1963 | Platt | 72/145 |
| 3,359,768 | 12/1967 | Platt | 72/142 |
| 3,401,557 | 9/1968 | Platt | 72/145 |
| 4,208,896 | 6/1980 | Platt | 72/145 |
| 4,258,561 | 3/1981 | Platt | 72/142 |

*Primary Examiner*—Lowell A. Larson
*Assistant Examiner*—Jorji M. Griffin
*Attorney, Agent, or Firm*—Price, Heneveld, Huizenga & Cooper

[57] ABSTRACT

A wire coiling machine of simplified construction, direct one-to-one synchronized drive from a rear drive arbor through a pair of friction drive rolls astraddle it, to a pair of flexible drive shafts connecting the drive rolls to a pair of front forming rolls of essentially the same diameter as the friction drive rolls, the forming rolls being astraddle the front forming arbor; the drive arbor having a diameter essentially the same as the outer diameter of a coil being formed on the forming arbor, and the forming arbor having a diameter essentially the same as the internal diameter of the coil being formed.

5 Claims, 4 Drawing Figures

COILING MACHINE

BACKGROUND OF THE INVENTION

Over the past few decades, the technology and requirements for wire coiling have changed significantly, from low volume coiling of relatively coarse wire using high power machines, usually with gear reduction mechanism, to coiling of ultrafine wire at high speeds and high output rates. This significant change was caused at least partially by efforts to save energy by using smaller resistance coils in heating elements, and at least partially due to sophistication of instrumentation and the like using coils. In coiling such fine wire, control of the coiling pressure is important, and in fact should be independent of drive pressure. The front forming rolls should apply balanced coiling pressure to both sides of the coil being formed around the forming arbor. Moreover, this should remain true even if the diameter of the forming rolls and/or drive rolls become worn or are modified slightly by regrinding of these rolls to accommodate for wear.

For practical reasons, the coiling power needs to be transferred from the rear of the coiling machine to the front where the coil is being formed. In times past, the power takeoff rolls at the rear were of very substantial diameter, e.g. at least four inches, and later greater than six inches in diameter, driving much smaller forming rolls at the front arbor, see for example the relationship between the roll diameters in my 1963 U.S. Pat. No. 3,082,810. Many years later, I developed the coiler in my 1981 U.S. Pat. No. 4,258,561 to coil very fine wire. Unfortunately, it was subsequently learned that the power pickup in that latter apparatus caused it to be extremely limited in the wire size it would accommodate. When coiling equipment is used on a production basis, regrinding of the power takeoff rolls and the coiling or forming rolls is a constant maintenance necessity, so that the usefulness of the apparatus in this '561 patent was considered too limited.

I have determined that the industry is now in need of a high speed production coiler for fine wire sizes, capable of day-in, day-out high speed production, with full synchronization from the rear arbor to the coil being formed. Such production requirements necessitate periodic regrinding of the resilient power rolls as well as the steel coiling or forming rings or rolls to accommodate for wear, causing diametral differences which the machine must automatically accommodate without loss of synchronization. Yet the machine should be simple and uncomplicated in construction, free of gear or belt reduction drive mechanisms from the rear rolls to the front rolls.

SUMMARY OF THE INVENTION

The coiler of this invention was conceived by me as a result of my realization of the present needs of the industry and based upon several decades of experience in developing and manufacturing coiling machines. The resulting product is a greatly simplified, uncomplicated, dependable machine considered capable of handling approximately 80% of the coiling needs existing. Viewing this novel coiler in hindsight, the construction with its simplicity and effectiveness seems readily understood. Yet its very uncomplicated, synchronized arrangement was not believed known heretofore. The high friction drive rolls at the rear arbor are essentially the same diameter as the front steel forming rolls or rings, the rear drive rolls engaging a rear drive arbor that has a diameter essentially the same as the outer diameter of the coil being formed on the front arbor. The front arbor has a diameter essentially the same as the internal diameter of the coil being formed. The rear drive rolls are mounted above their pivot shafts on their center of mass, and are biased toward the rear drive arbor therebetween. These are connected directly to the front forming rolls by flexible drive shafts which allow slight lateral movement of the forming rolls. The front forming rolls are suspended beneath pivot axes and are biased toward the forming arbor therebetween. Minor variations in the roll diameters due to wear and/or regrinding are readily accommodated, yet retaining full synchronization between the drive arbor and the coil being formed. Coiling pressures at the front arbor are independent of drive pressures, the coiling or forming rolls being capable of flexing laterally minor amounts while the flexible drive shafts keep the drive pressure constant.

The machine requires no frame. Rather, a single block of metal such as aluminum serves as a central element which sets up the relationships of parts. The parts are strung along three parallel rods for positioning and alignment. Synchronization of the coiling forces is built into the system, using a rear drive arbor essentially equal in diameter to the coil outer diameter. Wire diameter is thereby automatically compensated for because of speed equalization between the coil outer diameter and the coiling or forming ring surface, not the forming arbor.

DESCRIPTION OF THE PREFERRED EMBODIMENT

Figure 1:
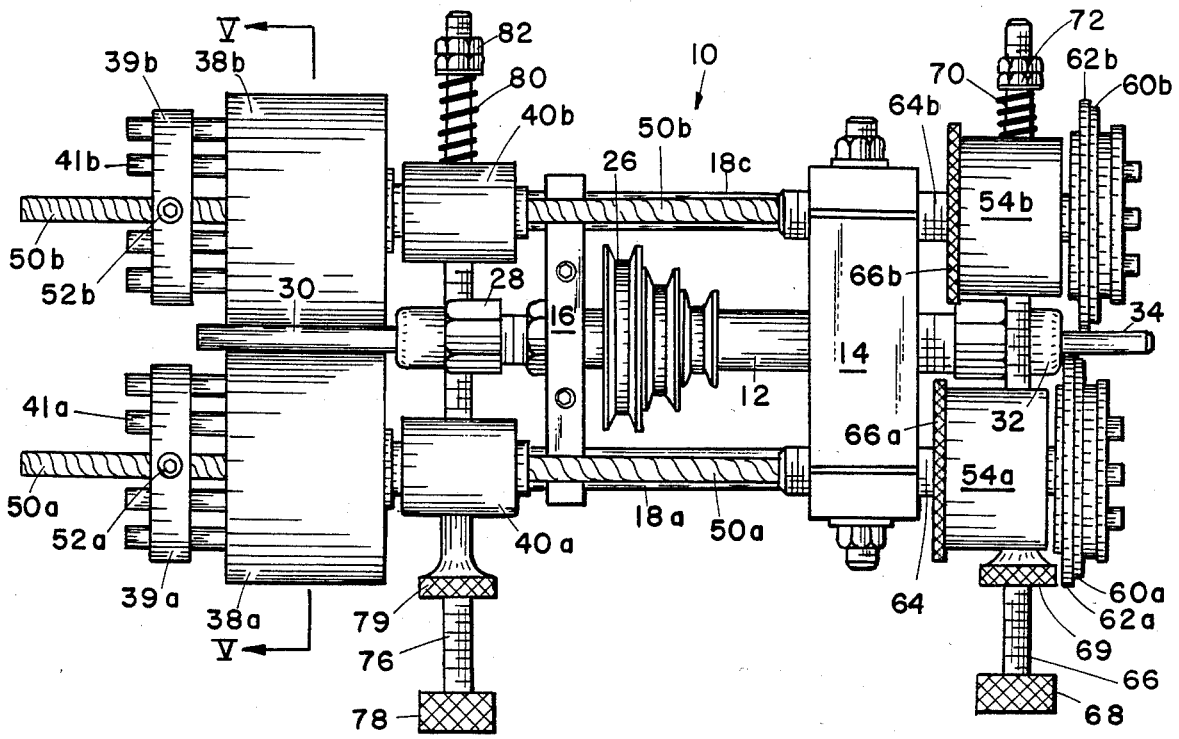
FIG. 1 is a top plan view of the coiling machine.
Figure 2:
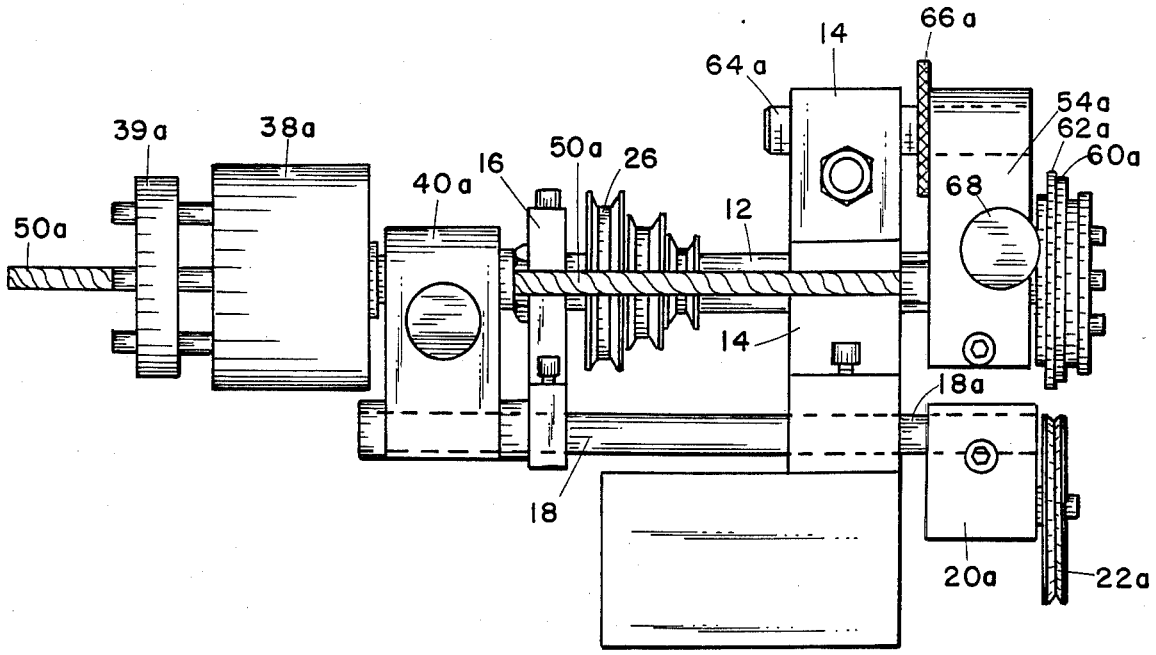
FIG. 2 is a side elevational view of the coiling machine.
Figure 3:
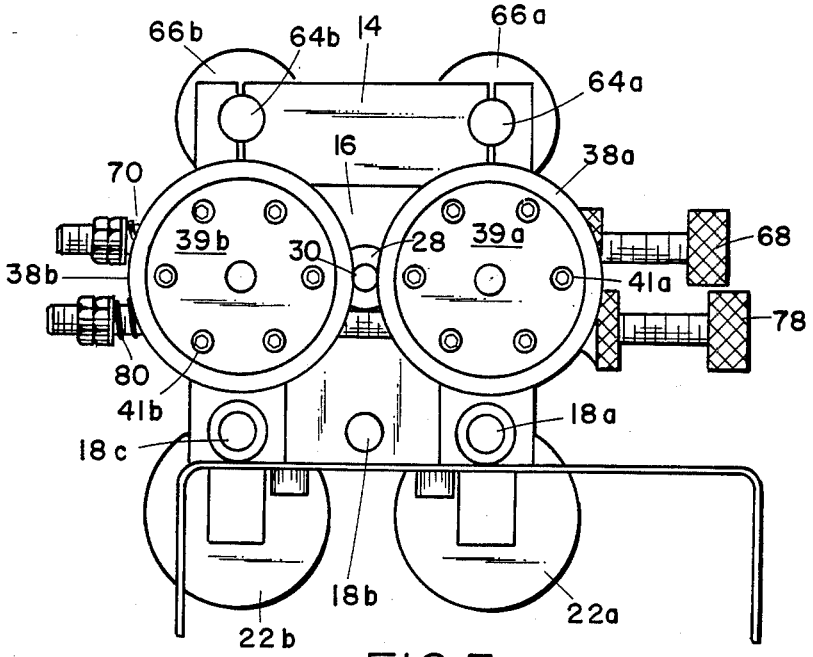
FIG. 3 is a rear elevational view of the coiling machine.
Figure 4:
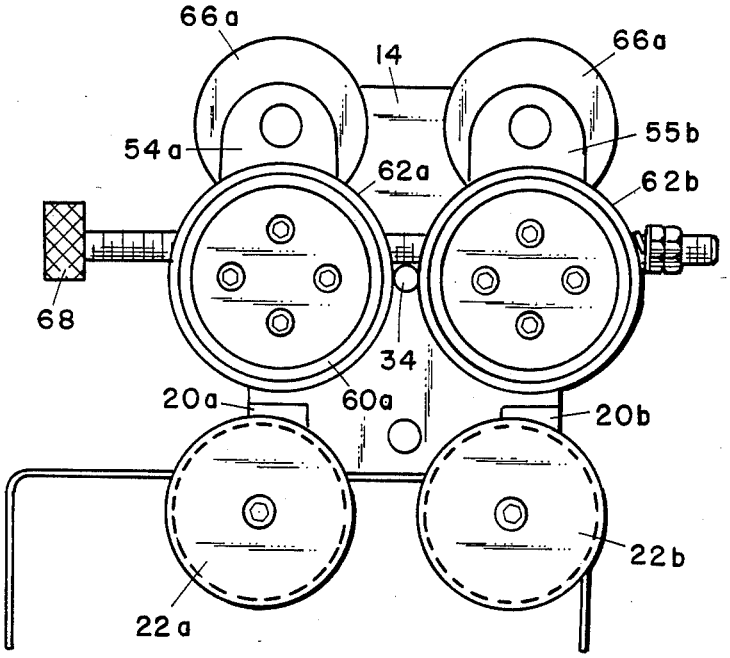
FIG. 4 is a front elevational view of the coiling machine.

The coiling machine 10 is centered about a central drive shaft 12 mounted in bearings in support block 14 as of aluminum, and rearwardly spaced block 16. Block 14 and block 16 are connected by three fixed tie rods 18*a*, 18*b* and 18*c*. The forward ends of these tie rods project past block 14 to enable a pair of hangers 20*a* and 20*b* to be suspended thereon for mounting the wire feed pulleys 22*a* and 22*b* of conventional type and shown for example in my U.S. Pat. No. 3,359,768 incorporated by reference herein.

Mounted on drive shaft 12 is one or more drive pulleys 26, here shown to be three in number and of differing diameters to allow a selected rotational speed of the drive shaft during operation. A suitable drive belt from a motorized source (not shown) engages the pulley. At the rear end of drive shaft 12 is a chuck 28 which retains a rearwardly projecting drive arbor 30. At the forward end of drive shaft 12 is another chuck 32 which retains a forwardly projecting front coiling arbor 34. This front forming arbor is preferably a full shoulder arbor of the type taught in my copending U.S. patent application Ser. No. 587,449 filed Mar. 8, 1984 and entitled FINE WIRE COILING.

Astraddle the rear drive arbor 30 is the pair of drive rolls 38*a* and 38*b* mounted on respective axle shafts having a bearing support within the upper portions of a pair of upstanding pivotal mounting blocks 40*a* and 40*b*. The lower ends of these mounting blocks are pivotally attached to the rear end portions of rods 18*a* and 18*c*. Thus, the drive rolls 38*a* and 38*b* are mounted upon these pivot rods, basically with the centerline of the mass of the rolls in the same vertical plane as the axis of the pivot rods. The periphery of these drive rolls constitutes a high friction material such as neoprene rubber for optimum drive engagement with the small diameter steel drive arbor 30 therebetween.

To the rear of the drive rolls, axially aligned therewith, is a pair of drive rings 39*a* and 39*b* secured by a plurality of connectors 41*a* and 41*b* to the drive rolls, and also attached to the rear ends of a pair of flexible cable drive shafts 50*a* and 50*b* as by set screws 52*a* and 52*b* (FIG. 1). These flexible drive shafts extend forwardly through drive rings 38*a* and 38*b*, blocks 40*a* and 40*b*, and through a pair of front hangers 54*a* and 54*b*, to the forming or coiling rings 60*a* and 60*b* and their adjacent backup rings 62*a* and 62*b* just to the rear of the forming rings. Forming rings 60*a* and 60*b* are purposely axially offset relative to each other to accommodate the pitch of the coil being formed, with backup rings 62*a* and 62*b* also being axially offset from each other a like amount. Backup rings 62*a* and 62*b* have a radius larger than forming rings 60*a* and 60*b* by an amount equal to the diameter of the wire being formed. Hanger brackets 54*a* and 54*b* have their upper ends pivotally attached to hollow threaded support rods 64*a* and 64*b* threadably attached to block 14, and axially adjustable relative to each other by the knurled rings 66*a* and 66*b* thereon for selected axial adjustment of the forming rings relative to each other to accommodate the desired coil pitch.

The biasing force on the backup rings 62*a* and 62*b* and forming rings 60*a* and 60*b* toward forming arbor 34 is controlled by the transverse threaded shaft 66 having a knurled knob 68 on one end thereof, extending through two hangers 54*a* and 54*b* and having a compression spring 70 and retention nuts 72 on the opposite end thereof. Adjustment of this threaded shaft and knurled lock knob 69 allows variation of the biasing pressure applied by the spring uniformly on both hangers and therefore uniformly on the forming and backup rolls relative to arbor 34.

A similar threaded biasing rod arrangement extends between mounts 40*a* and 40*b* for the drive rolls, i.e. threaded rod 76 having a knurled knob 78 and a knurled lock knob 79, spring 80 and retention nuts 82 on the opposite end thereof, for controlled balanced biasing of the drive rolls against drive arbor 30.

The diameter of the rear drive arbor 30 is essentially the same as the outer diameter of the wire coil being formed around forming arbor 34, i.e. the diametral spacing between the forming rolls 60*a* and 60*b*. The diameter of the front coiling arbor 34 is essentially the same as the internal diameter of the coil being formed. The diameter of the driving rolls 38*a* and 38*b* is essentially the same as the diameter of the forming or coiling rings or rolls 60*a* and 60*b*.

In operation of this apparatus, a suitable motor and belt drive pulley 26 on the main drive shaft, causing both the front and rear arbors to spin at a high speed. Spinning of rear drive arbor 30 causes the straddling engaging drive rolls 38*a* and 38*b* to rotate, thereby driving flexible drive shafts 50*a* and 50*b* and hence the front forming and backup rolls, causing the peripheral speed of forming rolls 60*a* and 60*b* to be essentially the same as the peripheral speed of drive rolls 38*a* and 38*b*. This peripheral speed therefore is the same as the peripheral outer diameter speed of the coil being formed around arbor 34, from wire fed over the feed pulleys 22*a* and 22*b* in the manner shown by my prior U.S. Pat. No. 3,359,768 referred to hereinabove. The peripheral speed of the coil being formed remains synchronized with the peripheral speed of drive arbor 30. Any minor variations in the forming roll and/or drive roll diameters are accommodated by the microflexing of the forming rolls laterally as suspended by their hangers on pivot rods. The flexible drive shafts enable this minor flexing without disturbing the synchronization between the peripheral speeds noted above. Further, with additional minor variations in forming roll diameter and/or drive roll diameter due to regrinding after wear conditions during extended production, the synchronization is maintained.

The result is a smooth, reliable, simple, uncomplicated, synchronized mechanism having forming pressures independent of the drive pressures, with full synchronization being maintained from the rear drive arbor to the exterior of the coil being formed.

Conceivably, minor variations might be made in the specific form of the apparatus depicted and considered to constitute the preferred embodiment of my invention. Hence, it is intended that the invention is to be limited only by the scope of the appended claims and the reasonable equivalents to those defined therein.

The embodiments of the invention in which an exclusive property or privilege is claimed are defined as follows:

1. A wire coiling apparatus comprising:

a rotational arbor shaft with a forming arbor at the front end and a drive arbor at the rear;

a rear drive rolls astraddle said drive arbor and having a frictional peripheral surface material in engagement with said drive arbor;

front forming rolls astraddle said forming arbor, having coil-forming peripheral surfaces for engagement with a wire coil being formed around said forming arbor;

the diameter of said drive rolls being essentially the same as the diameter of said forming rolls, and flexible drive cable shafts between respective of said drive rolls and forming rolls, to cause a one-to-one drive therebetween while accommodating slight diametral variations by minor lateral movement of said forming rolls.

2. The wire coiling apparatus of claim 1 wherein the diameter of said rear drive arbor is essentially the same as the outer diameter of the coil being formed on said front forming arbor.

3. The wire coiling apparatus of claim 1 wherein the diameter of said rear drive arbor is essentially the same as the outer diameter of the coil being formed on said front forming arbor, and the diameter of said front forming arbor is essentially the same as the inner diameter of the coil being formed thereon.

4. The wire coiling apparatus of claim 2 wherein said forming rolls are suspended on hangers pivotally mounted at the upper portions of said hangers, and biased toward said forming arbor.

5. The wire coiling apparatus of claim 4 wherein said drive rolls are mounted upstanding on rear supports attached on their lower end portions to pivot rods, and biased toward said drive arbor.

* * * * *